US007849634B2

(12) United States Patent
Subiñas

(10) Patent No.: US 7,849,634 B2
(45) Date of Patent: Dec. 14, 2010

(54) VEHICLE WINDOW REGULATOR DEVICE, METHOD OF INSTALLATION OF A VEHICLE WINDOW REGULATOR DEVICE, AND A VEHICLE WINDOW REGULATOR LOCKING DEVICE

(75) Inventor: Valeriano Nuñez Subiñas, Burgos (ES)

(73) Assignee: Grupo Antolin-Ingenieria, S.A., Burgos (ES)

( * ) Notice: Subject to any disclaimer, the term of this patent is extended or adjusted under 35 U.S.C. 154(b) by 646 days.

(21) Appl. No.: 11/669,038

(22) Filed: Jan. 30, 2007

(65) Prior Publication Data

US 2007/0209282 A1 Sep. 13, 2007

(30) Foreign Application Priority Data

Jan. 31, 2006 (EP) ..... 06380027

(51) Int. Cl.
*E05F 15/08* (2006.01)

(52) U.S. Cl. ..... 49/349; 49/348

(58) Field of Classification Search ..... 49/348, 49/349, 350, 351
See application file for complete search history.

(56) References Cited

U.S. PATENT DOCUMENTS

| | | | | |
|---|---|---|---|---|
| 3,659,381 | A * | 5/1972 | Frey et al. | 49/103 |
| 3,670,454 | A * | 6/1972 | Gebhard et al. | 49/103 |
| 3,745,703 | A * | 7/1973 | Francis et al. | 49/103 |
| 3,788,005 | A * | 1/1974 | Mistopoulos, Jr. | 49/103 |
| 3,816,961 | A * | 6/1974 | Mistopoulos, Jr. | 49/103 |
| 3,816,962 | A * | 6/1974 | Ladd et al. | 49/103 |
| 4,000,581 | A * | 1/1977 | Fukumoto et al. | 49/103 |
| 4,069,616 | A * | 1/1978 | Doveinis | 49/103 |
| 5,850,711 | A * | 12/1998 | Takahashi et al. | 49/351 |
| 6,073,395 | A * | 6/2000 | Fenelon | 49/358 |
| 6,530,175 | B2 * | 3/2003 | Sato et al. | 49/138 |
| 2002/0104267 | A1 * | 8/2002 | Sato et al. | 49/350 |
| 2005/0091929 | A1 * | 5/2005 | Shibata | 49/350 |

FOREIGN PATENT DOCUMENTS

| | | |
|---|---|---|
| DE | 3 506 771 | 8/1986 |
| JP | 2000-027532 | 1/2000 |

* cited by examiner

*Primary Examiner*—Jerry Redman
(74) *Attorney, Agent, or Firm*—Knobb Martens Olson & Bear, LLP.

(57) ABSTRACT

It comprises a housing (3) configured for attachment to a panel (4) for a vehicle door, a toothed component (2) which is jointed to the housing (3) and comprises a toothed portion (2'), a toothed gear (5) which meshes with the toothed portion (2') of the toothed component (2), at least one arm (1), which comprises a first end for supporting the window and a second end attached to the toothed component (2), the gear, the toothed component and the arm being connected so that, as the gear turns, it moves the first end of the arm and a retaining element (7) configured and installed so that it may move between an operational position, in which it locks the toothed component (2), and a non-operational position, in which it does not lock the toothed component (2).

23 Claims, 6 Drawing Sheets

VEHICLE WINDOW REGULATOR DEVICE, METHOD OF INSTALLATION OF A VEHICLE WINDOW REGULATOR DEVICE, AND A VEHICLE WINDOW REGULATOR LOCKING DEVICE

CROSS-REFERENCE TO RELATED APPLICATIONS

The present application claims the benefit under 35 U.S.C. 119(a)-(d) of European Patent Application No. 06380027.0, the entire contents of which are incorporated herein by reference.

TECHNICAL FIELD OF THE INVENTION

The present invention is applicable in the field of vehicle window regulators and more specifically in the field of motor-operated window regulators.

BACKGROUND OF THE INVENTION

A vehicle window regulator usually comprises a housing or support plate that is fixed to the panel forming the door of the vehicle, one or more arms supporting the window by means of various anchorage means, an operating motor mounted in the housing, which moves a gear that engages in a toothed portion of a toothed component that is attached at its opposite end to one of the arms supporting the window, so that the motor brings about the movement of the gear and the toothed component, giving rise to the movement of the arms and, as a result, the raising or lowering of the window. The window regulator may comprise a guide, which is also fixed to the vehicle door panel, to which one of the arms is attached in order to secure a guided movement of same.

As a rule, all the components of the window regulator device are pre-installed in the housing (including the drive motor), prior to its attachment to the door of the vehicle. In these cases, to carry out the installation of the window regulator on the vehicle door, first of all, the housing is fixed to a part of the door which lies in the interior of the vehicle and then the guide is fixed to the same part of the door. The window is set in place by means of the anchorage means and it is supported by the arms of the window regulator. During the window fitting operations the position of the arms remains fixed (they do not move under the effect of the weight of the window), as the toothed component is locked by means of the gear, which is held by the drive motor.

It could also be the case that the drive motor is not pre-installed, along with the other components, before the window regulator is fitted in the vehicle door. In this case, at the time of carrying out the installation of the window regulator in the vehicle door, the gear will be engaged with the toothed component, but without there being any braking mechanism between the two, so the toothed component may move in relation to the gear, which means that the arms may adopt a variety of positions during the installation of the window. We should be taking into consideration that the position of the arm at the time of the installation of the window should correspond to a specific position between the toothed component and the gear, which assures the full travel of the window during its operation, i.e. the window is raised or lowered fully. In this case, the drive motor would be fitted after installing the window regulator.

Invention patent JP 2000027532 refers to a retaining device in which the gear engages with the toothed component and is in turn engaged in some projections provided on a fixed plate that prevent it from moving. On the end of the shaft on which the gear is mounted there is a tapered spring that keeps the gear coupled to the plate in its expanded position. When the motor is fitted on the gear shaft, the gear exerts pressure and compresses the tapered spring so that the gear is released from the fixed plate while the gear and the toothed component are held in the engaged position.

In this case, when the motor is installed on the gear shaft, the gear withstands the torsion stress applied by the toothed component, which may damage the gear or require a degree of strength in its design that is unnecessary for its operation. The need to fit this plate also involves the occupancy of a space between the gear and the electric motor.

Furthermore, in invention patent DE 3 506 771 we observe a retaining device consisting of stops each limiting the travel of the toothed component in two possible directions. By means of this arrangement there is no locking as such, but rather travel limit positions, so a fixed position of the toothed component cannot always be guaranteed for the installation of the window.

DESCRIPTION OF THE INVENTION

The window regulator device of the invention comprises a device for locking the position of the toothed component, which enables a fixed position to be established for the window regulator arm or arms during the installation of the window regulator device on the vehicle door so as to facilitate the fitting of the window and be able to assure its full travel, both during raising and lowering, all this without it being necessary to pre-install the drive motor.

The window regulator device comprises:

a housing configured for fixing to a metal vehicle door panel, on a part of it which lies within the interior of the vehicle, a toothed component which is jointed to the housing and comprises a toothed part, a toothed gear which engages in the toothed portion of the toothed component, at least one arm, which comprises a first end for supporting the window and a second end attached to the toothed component, the gear, the toothed component and the arm being related in such a way that, as the gear turns, it causes the first end of the arm to move, and a device for locking the position of the toothed component, which comprises a retaining element configured and installed in such a way that it may move between one operational position, in which the toothed component is locked, and a non-operational position, in which the toothed component is not locked.

The retaining element is pre-installed in the housing and it is in its operational position (locking the toothed component) until the drive motor is installed in the housing, i.e. the retaining element is fitted and locking the position of the toothed component during the operations of setting the window in place on the aforesaid at least one arm and continues to hold the position of the window regulator device until the drive motor is fitted in the housing in a later installation operation.

As will be described later, the actual operation of fitting the drive motor in the housing causes the retaining element to shift from the operational to the non-operational position, being from then on the actual drive motor that holds the toothed component in its position by way of the gear.

From this position, the window regulator device is ready for its operation (raising and lowering the window powered by the drive motor), during which the retaining element remains fitted in the housing, but in its non-operational position.

The retaining element comprises a first arm provided at one of its ends with interlocking means, which, in the operational position of the retaining element, are disposed in alignment with a part of the toothed portion of the toothed component, thus locking it. The interlocking means are preferably made up of at least one tooth with a configuration complementary to the afore-mentioned part of the toothed portion of the toothed component.

The retaining element may comprise a second arm by means of which it is fixed to the housing and which permits a relative movement between the retaining element and the housing so as to shift from an initial position for installation on it to the retaining element operational position.

The first arm and the second arm may be joined by elastic means so that the first can move, by elastic deformation of the elastic means, from the operational position, in which the toothed component is locked, to the non-operational position, in which the toothed component is not locked. This movement of the first arm takes place in a direction substantially perpendicular to the meshing plane between the first arm and the toothed portion of the sector gear, i.e. an imaginary plane that would contain the toothed portion of the toothed component of the end and the interlocking means of the first arm.

The retaining element should preferably be made of plastic material.

The housing comprises locking or stop means that prevent the withdrawal of the retaining element in respect of the housing. Specifically, the locking means are preferably designed to lock the second arm of the retaining element, thereby preventing it from moving in the aforesaid direction perpendicular to the meshing plane between the first arm and the toothed portion of the toothed compound, but permitting the movement of the first arm in the aforesaid perpendicular direction. It also comprises rotation inhibiting means that stop the retaining element from moving (turning) in relation to the housing.

The locking means are preferably designed to lock the second arm of the retaining element.

The window regulator device of the invention also comprises a drive motor which is fitted in the housing after the window is set in place. The drive motor is fixed to the housing by way of at least one bolt with a stem length such that it traverses and passes to the other side of the housing. This bolt is disposed to match up with the position of the first arm of the retaining element, in the latter's operational position, so that the fixing of the bolt to the housing causes the stem of the bolt to exert pressure against the first arm, in a direction perpendicular to the meshing plane between the first arm of the retaining element and the toothed portion of the toothed component, causing the first arm to move from its operational to its non-operational position, leaving the locking means of the first arm disengaged in respect of the toothed component.

A further object of the invention is a method of fitting a vehicle window regulator that facilitates the window installation operations when the drive motor is pre-installed in the housing, and the window regulator device is therefore installed on the vehicle door without the drive motor.

The method comprises the following steps:

fitting in a housing a gear, a toothed component comprising a toothed portion, so that said toothed portion engages with the gear, and at least one arm comprising a first end to support a window and a second end which is attached to the toothed component, in such a way that the rotation of the gear causes the movement of the first end of the arm by way of the toothed component and fitting in said housing a retaining element comprising a first arm, which is provided at one of its ends with interlocking means, disposed in alignment with a part of the toothed portion of the toothed component, thus locking it.

The method of installation also comprises the step of fitting a drive motor in the housing by means of at least one bolt that traverses the housing in alignment with the first arm of the retaining element, in the latter's operational position, pushing the first arm in a direction perpendicular to a meshing plane between the first arm of the retaining element and the toothed portion of the toothed component, thereby moving the first arm from the operational position to a non-operational position in which the retaining element does not lock the toothed component.

This method enables to install the window regulator device in the vehicle door without the drive motor, leaving the position of the toothed component and, therefore, of the aforesaid at least one arm locked by the retaining element, with the result that window may be fitted in a straightforward and convenient way, with the assurance that the window travel will be complete both in both the raising and lowering operation.

Furthermore, the fitting of the motor at a later stage, with the window regulator device already attached to the vehicle door panel, makes it possible to separate the two stages of installation, so that for instance the supplier of the window regulator device may install this, and then the motor for example may be installed by a different supplier from the supplier of the window regulator device.

In the event of the door being configured so that it defines a wet area and a dry area, i.e. an area that is isolated or sealed (dry area) and a non-sealed area (wet area), it is possible to place the window regulator device (without the drive motor) in the wet area, while the drive motor could be in the dry area, so that the drive motor may have less demanding technical requirements and, therefore, be cheaper.

DESCRIPTION OF THE DRAWINGS

To complete the description that is being given and in order to assist a fuller appreciation of the features of the invention, in accordance with a preferred practical embodiment of same, a set of drawings is attached as an integral part of this description, wherein for informative but non-restrictive purposes the following is represented.

PREFERRED EMBODIMENT OF THE INVENTION

In the light of the figures a preferred embodiment of the window regulator device and of the locking device object of the invention is following described.

Figure 1:
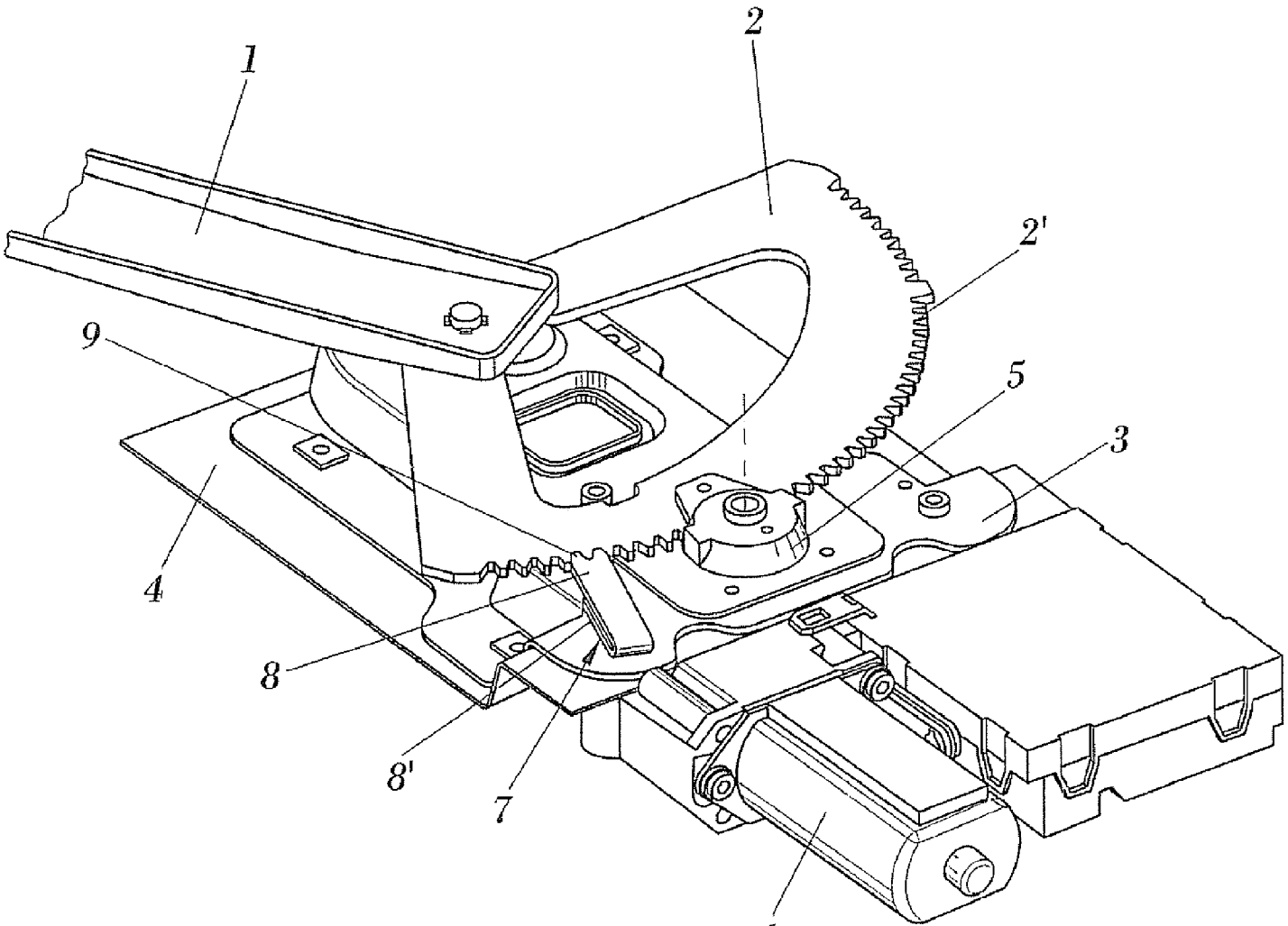
FIG. 1.—It shows a perspective view in which we observe the vehicle window regulator device that is the object of the invention with the locking device of the invention in the operational position in which it locks the toothed component, with the drive motor in its installation position but prior to its fixing to the housing.

As may be seen in FIG. 1, the window regulator device consists of a housing (3) for attachment to the door panel (4) of a vehicle (partly represented), a toothed gear (5) that meshes with a toothed portion (2') of a toothed component (2) attached to an arm (1), which supports the window by way of an end not shown. The movement of the gear (5) causes the movement of the toothed component (2) and this in turn of the arm (1), which raises or lowers the window. FIG. 1 also shows a drive motor (6) for moving the toothed gear (5).

The window regulator device comprises a retaining element (7), mounted in the housing (3) in such a way that it may move between an operational position, which locks the toothed component (2) (position represented in FIG. 1), and a non-operational position, in which it does not lock the toothed component (2).

In accordance with the preferred embodiment, the retaining element (7) comprises a first arm (8) and a second arm (8') which are joined by means of an elastic elbow and disposed one above the other.

At its free end the first arm (8) comprises interlocking means (9), for instance, a pair of teeth of a configuration complementary to a part of the toothed portion (2') of the toothed component (2), so that in the operational position of the retaining element (7), they are coupled (meshing) with a part of the toothed portion (2') of the toothed component (2), thereby locking it. This position is shown in FIG. 1.

The housing (3) comprises locking means (13), taking the form for instance of an elbow lug which is disposed on the second arm (8') of the retaining element (7), in a direction perpendicular to the meshing plane that is defined between the toothed portion (2') and the interlocking means (9), in such a way that in its operational position the retaining element (7) cannot be detached from the housing (3).

The second arm (8') comprises a hole (12) designed to be housed on a turret-like protuberance (10) defined in the housing (3), so that the retaining element (7) can turn in relation to the protuberance (10), parallel to the meshing plane between the interlocking means (9) and the toothed portion (2'), from an initial position for fitting the retaining element (7) up to its operational position.

Figure 3:
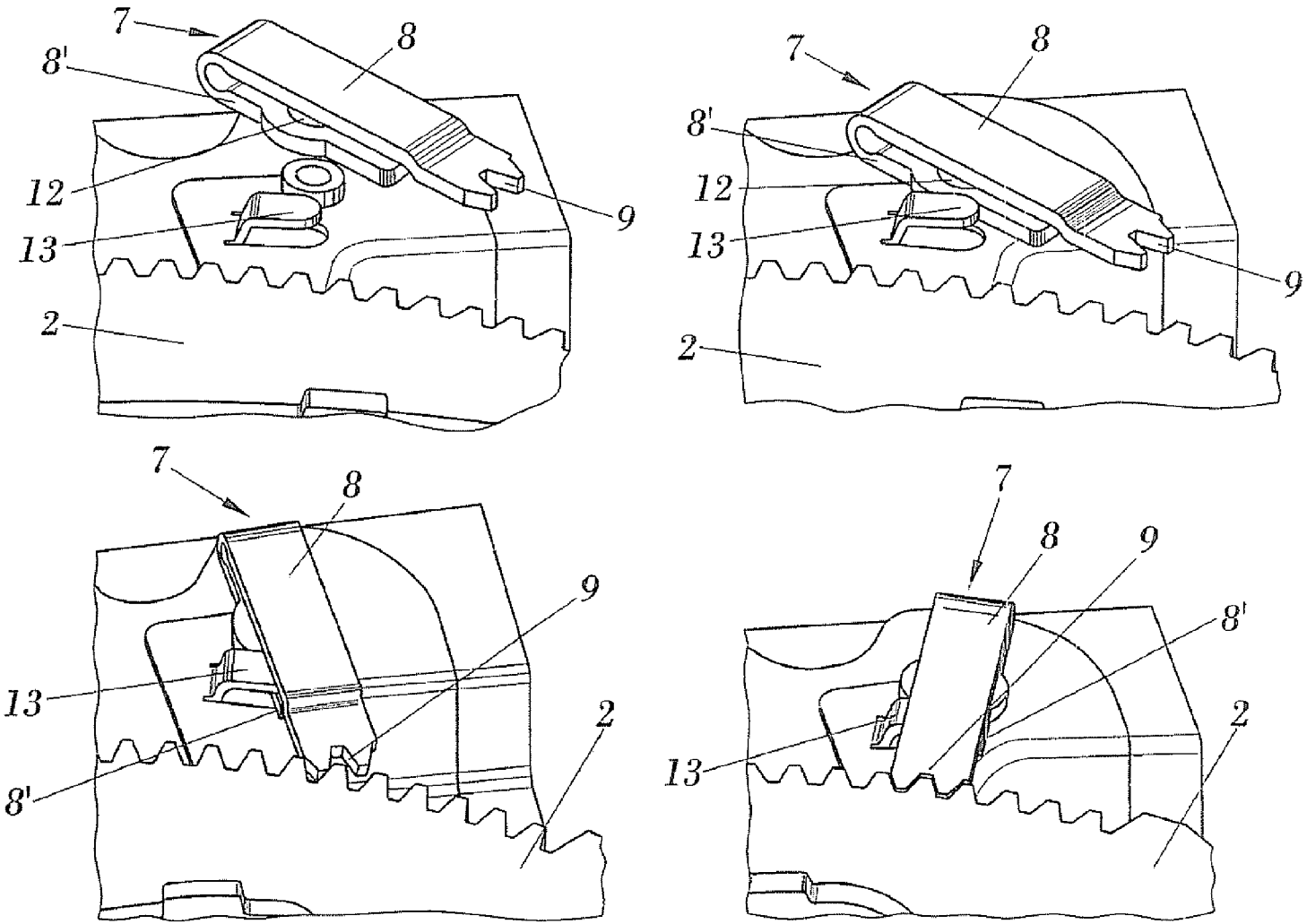

The stages of installation of the retaining element (7) in the housing (3) are described in FIG. 3. First of all, the retaining element (7) is set in place on the protuberance (10) of the housing (3) and is accommodated in the hole (12) in the retaining element (7), in a position of the retaining element in which the interlocking means (9) are slightly removed from the toothed portion (2') of the toothed component (2). The retaining element (7) is then turned in relation to the protuberance (10) until the interlocking means (9) are engaged (mesh) with the toothed portion (2') of the toothed component (2). In this position, the second arm (8') of the retaining element (7) is disposed below the locking means (13) and, therefore, the retaining element (7) cannot be detached from the housing. In this position, the retaining element (7) is in its operational position, locking the toothed component (2).

Figure 2:
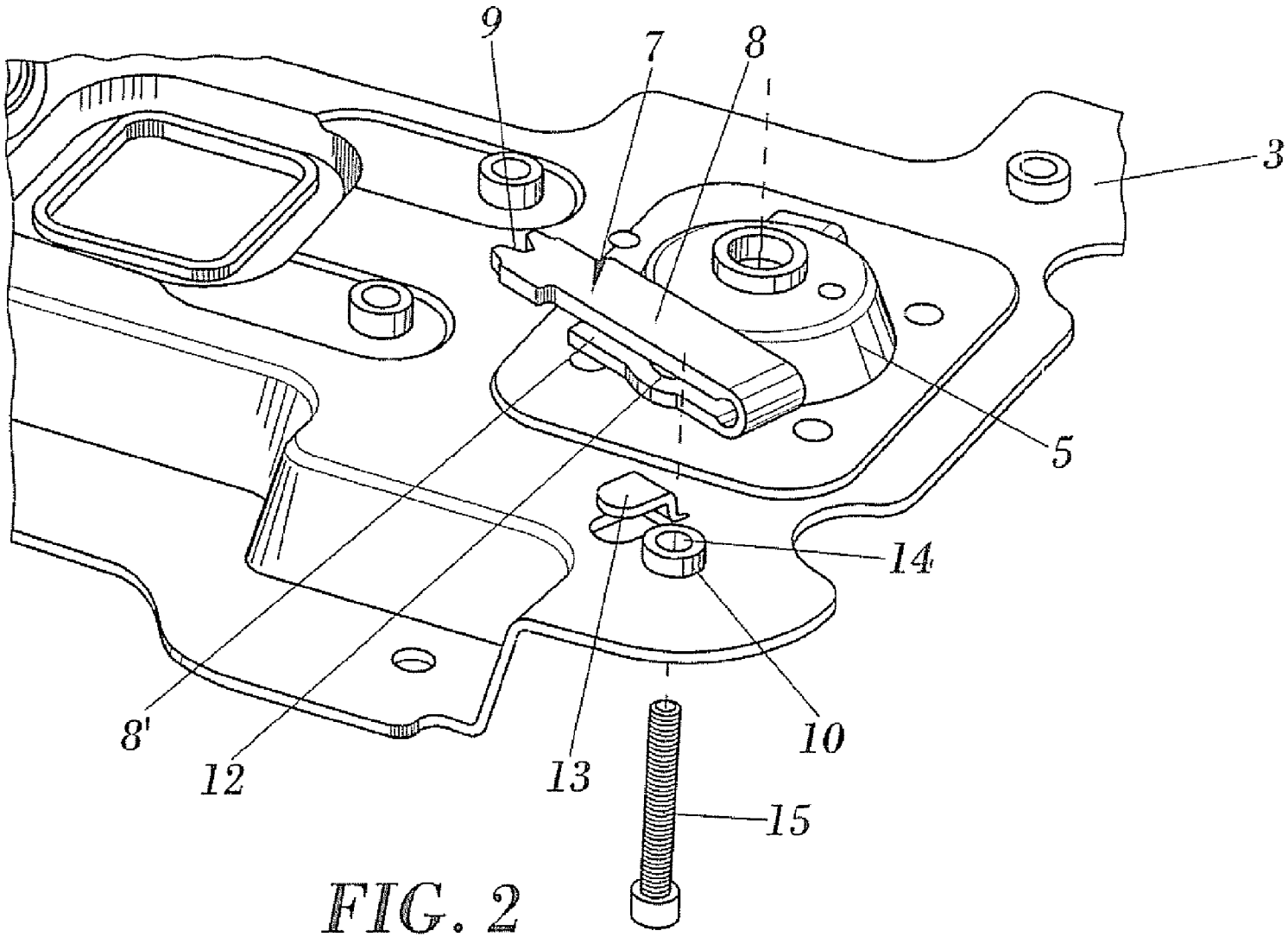
FIG. 2.—It shows an exploded perspective view of the part of the housing in which the retaining element is installed, where the drive motor fixing bolt and the locking means that prevent the movement of the retaining element in relation to the housing are shown FIG. 3.—It shows a sequence of the installation of the retaining element in the housing.

The window regulator device also comprises a drive motor (6) which is attached to the housing (3), by way of a bolt (15). As may be observed in FIGS. 2 and 4, the bolt (15) is disposed in alignment with the retaining element (7). Specifically, the second arm (8') presents a hole (12) in alignment with a hole (14) in the housing (3) and with a hole in the panel (4), so that in the position of fixing the drive motor (6) to the housing (3) the stem (15) passes through the hole in the panel (4) and through holes (14) and (12) until reaching the first arm (8) of the retaining element (7), forcing it upwards in relation to the housing (3), in a direction perpendicular to the meshing plane between the interlocking means (9) and the toothed portion (2') of the toothed component (2), causing disengagement (unmeshing) between the interlocking means (9) and the toothed portion (2'). This is the non-operational position of the retaining element (7).

Figure 4:
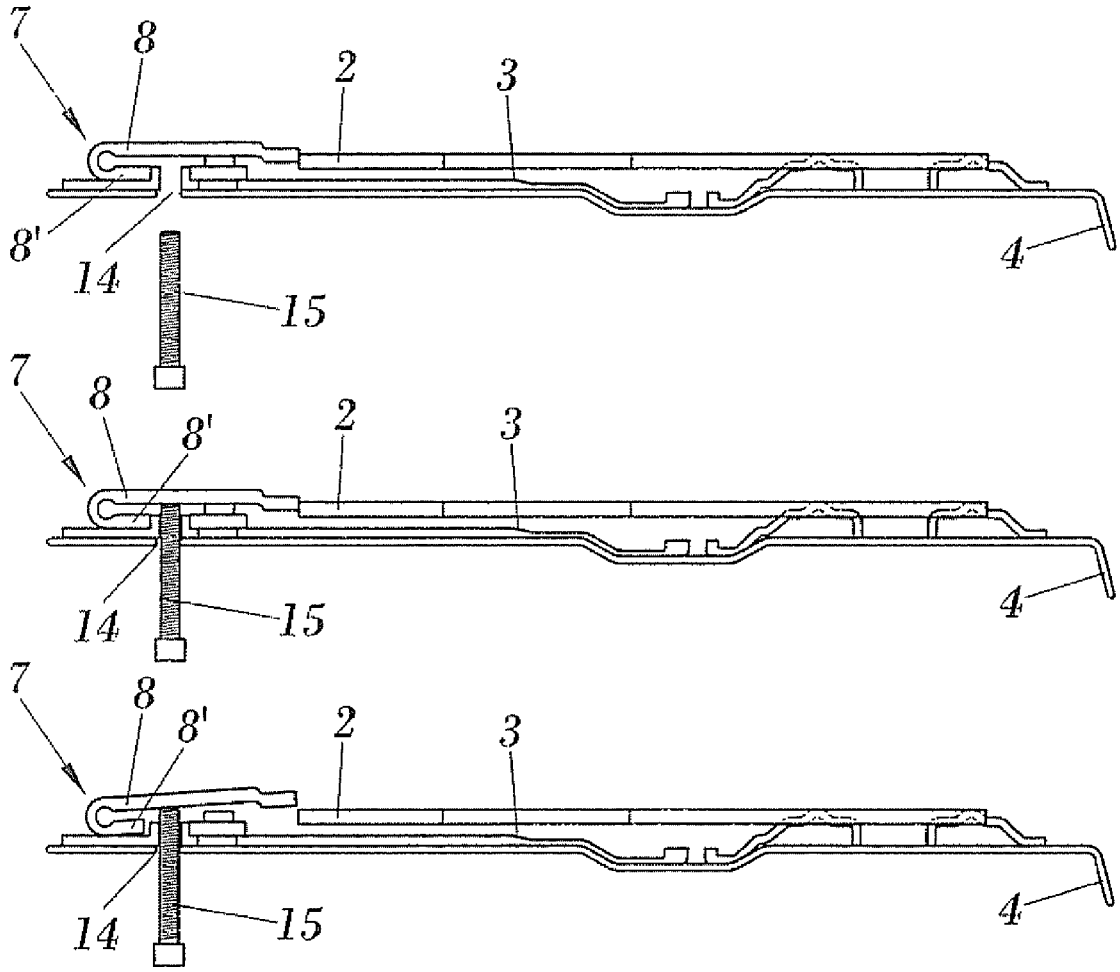
FIG. 4.—It shows a diagrammatic side view, wherein a sequence of the installation of the drive motor is shown, but in which the motor is not represented so as to improve the clarity of the figure.
Figure 5:
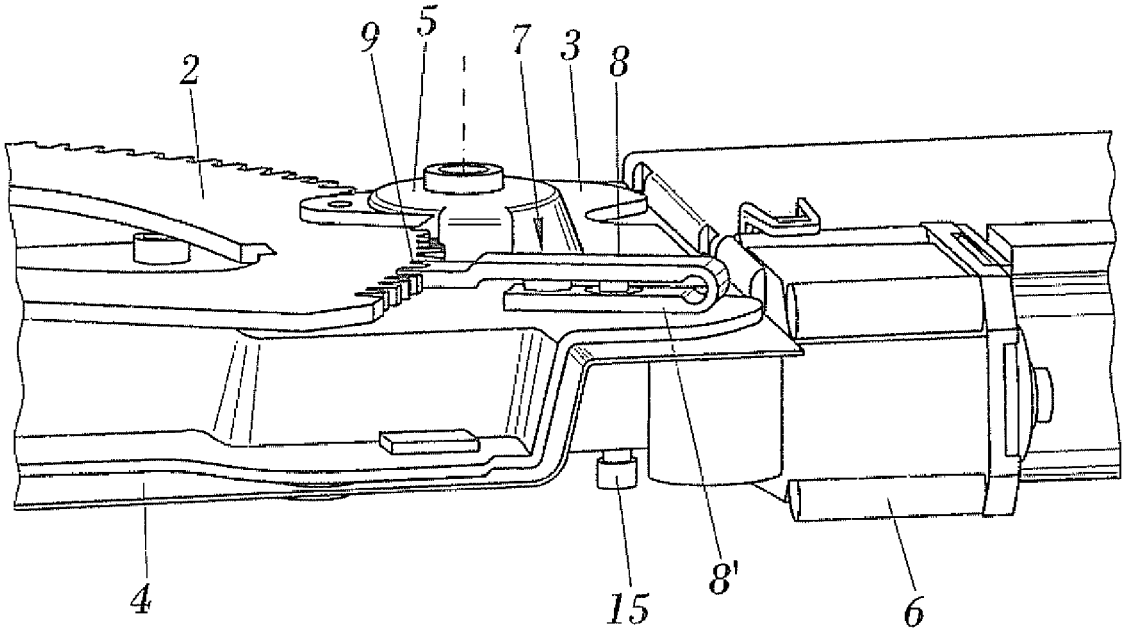
FIG. 5.—It shows a side perspective view in which we observe the retaining element installed in the housing in its operational position with the drive motor in its installation position but prior to its being bolted to the housing.

The sequence of fixing the drive motor (6) by way of the bolt (15) is shown in FIG. 4.

The installation of the drive motor (6) in the housing (3) by means of the bolt (15) causes the retaining element (7) to shift from the locking position to the non-locking position. In this way, it completes the installation of the window regulator device (with the drive motor (6)), which is thereby made operational for its normal working, so that the retaining element (7) can be fitted in the housing (3) during the normal working of window regulator, but without interfering with its operation. In other words, the retaining element (7) has performed its function (facilitating window fitting) and is no longer necessary.

Figure 6:
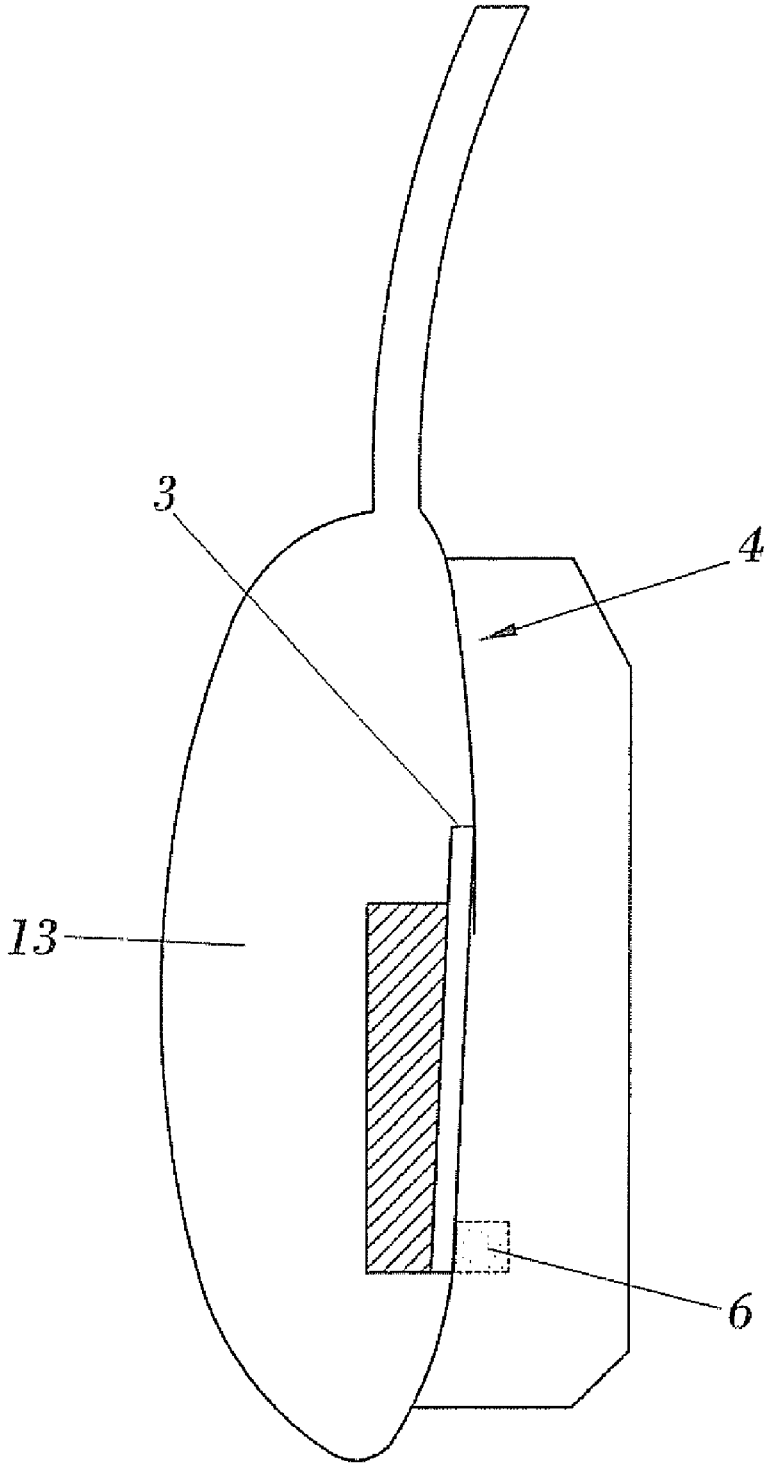
FIG. 6.—It shows a diagrammatic representation, wherein a door with a wet area is shown, in which the window regulator device is installed, without the drive motor, and a dry area, in which the drive motor is fitted.

The method and device of the invention permit the initial installation of the window regulator device (without the drive motor (6)) in the wet area (13) of the vehicle door, as may be observed in FIG. 6, and the subsequent installation of the drive motor (6) in the dry area (16) of the door.

What is claimed is:

1. Vehicle window regulator device, which comprises:

a housing configured to be attached to a panel for a vehicle door, a toothed component, which is jointed to the housing and comprises a toothed portion, a toothed gear which meshes with the toothed portion of the toothed component, at least one arm, which comprises a first end to support the window and a second end attached to the toothed component, the toothed gear, the toothed component and the arm being connected in such a way that, as the toothed gear turns, said toothed gear causes the first end of the arm to move;

wherein, in addition, said device comprises a retaining element configured and installed so that said retaining element may move between an operational position, in which said retaining element locks the toothed component, and a non-operational position, in which said retaining element does not lock the toothed component;

wherein the retaining element comprises interlocking means which are disposed, in the operational position of the retaining element, in alignment with a part of the toothed portion of the toothed component, thereby locking said toothed portion; and wherein the retaining element comprises a first arm, which is provided at one of its ends with interlocking means that comprise at least one tooth for meshing with a part of the toothed portion of the toothed component.

2. Vehicle window regulator device, according to claim 1, wherein the retaining element also comprises a second arm rotatably fixed to the housing, permitting the movement of the retaining element in relation to the housing.

3. Vehicle window regulator device, according to claim 2, wherein the first arm may move in a direction substantially perpendicular to a meshing plane between the first arm of the retaining element and the toothed portion of the toothed component so as to shift from the operational to the non-operation position.

4. Vehicle window regulator device, according to claim 2, wherein the housing comprises locking means that prevents the movement of the second arm of the retaining element in a direction substantially perpendicular to a meshing plane between the first arm of the retaining element and the toothed portion of the toothed component.

5. Vehicle window regulator device, according to claim 3, wherein the first arm and the second arm of said retaining element are joined by way of elastic means.

6. Vehicle window regulator device, according to claim 4, wherein the locking means comprises an elbow lug which is disposed on the second arm of the retaining element, in said direction substantially perpendicular to said meshing plane, in the operational position of the retaining element.

7. Vehicle window regulator device, according to claim 2, wherein the second arm comprises a hole which is accommodated on a turret-shaped protuberance defined in the housing, with the result that the retaining element can turn in relation to the protuberance, parallel to a meshing plane between the first arm of the retaining element and the toothed portion of the toothed component.

8. Vehicle window regulator device, according to claim 1, wherein said device further comprises a drive motor for the rotation of the toothed gear.

9. Vehicle window regulator device, according to claim 8, wherein the drive motor is fixed to the housing by way of a bolt, said bolt comprising a stem which traverses the housing, in alignment with the first arm of the retaining element, in the operational position of said retaining element, pushing the first arm in a direction perpendicular to a meshing plane between the first arm of the retaining element and the toothed portion of the toothed component, thus shifting the first arm from its operational to its non-operational position.

10. Vehicle window regulator device, according to claim 9, wherein said retaining element comprises a second arm, and wherein the second arm comprises a through-hole via which the bolt passes when the drive motor is anchored to the housing.

11. Vehicle window regulator device, according to claim 1, wherein the retaining element is made of plastic material.

12. Method for installing the vehicle window regulator device according to claim 1, said method comprising:

installing in the housing the toothed gear, and the toothed component comprising the toothed portion, so that said toothed portion engages with the toothed gear, installing the at least one arm, in such a way that the rotation of the toothed gear causes the movement of the first end of the arm by way of the toothed component; and fitting in said housing the retaining element comprising a first arm which is provided at one of its ends with interlocking means, disposed in alignment with a part of the toothed portion of the toothed component, thus locking said toothed portion.

13. Method according to claim 12, further comprising the step of installing a drive motor in the housing by means of at least one bolt, said bolt comprising a stem which traverses the housing, in alignment with the first arm of the retaining element, in the operational position of said retaining element, pushing the first arm in a direction perpendicular to a meshing plane between the first arm of the retaining element and the toothed portion of the toothed component, thus shifting the first arm from said operational position to said non-operational position.

14. Vehicle window regulator device, which comprises:

a housing configured to be attached to a panel for a vehicle door, a toothed component, which is jointed to the housing and comprises a toothed portion, a toothed gear which meshes with the toothed portion of the toothed component, at least one arm, which comprises a first end to support the window and a second end attached to the toothed component, the toothed gear, the toothed component and the arm being connected in such a way that, as the toothed gear turns, said toothed gear causes the first end of the arm to move;

wherein, in addition, said device comprises a retaining element configured and installed so that said retaining element may move between an operational position, in which said retaining element locks the toothed component, and a non-operational position, in which said retaining element does not lock the toothed component;

wherein the retaining element comprises interlocking means which are disposed, in the operational position of the retaining element, in alignment with a part of the toothed portion of the toothed component, thereby locking said toothed portion;

wherein the retaining element comprises at least one arm, which is provided at one of its ends with interlocking means that comprise at least one tooth for meshing with a part of the toothed portion of the toothed component; and wherein the retaining element also comprises a second arm rotatably fixed to the housing, permitting the movement of the retaining element in relation to the housing.

15. Vehicle window regulator device, according to claim 14, wherein the first arm may move in a direction substantially perpendicular to a meshing plane between the first arm of the retaining element and the toothed portion of the toothed component so as to shift from the operational to the non-operation position.

16. Vehicle window regulator device, according to claim 15, wherein the first arm and the second arm of said retaining element are joined by way of elastic means.

17. Vehicle window regulator device, according to claim 15, wherein the first arm may move in a direction substantially perpendicular to a meshing plane between the first arm of the retaining element and the toothed portion of the toothed component so as to shift from the operational to the non-operation position.

18. Vehicle window regulator device, according to claim 17, wherein the locking means comprises an elbow lug which is disposed on the second arm of the retaining element, in said direction substantially perpendicular to said meshing plane, in the operational position of the retaining element.

19. Vehicle window regulator device, according to claim 14, wherein the housing comprises locking means that prevents the movement of the second arm of the retaining element in a direction substantially perpendicular to a meshing plane between the first arm of the retaining element and the toothed portion of the toothed component.

20. Vehicle window regulator device, according to claim 14, wherein the second arm comprises a hole which is accommodated on a turret-shaped protuberance defined in the housing, with the result that the retaining element can turn in relation to the protuberance, parallel to a meshing plane between the first arm of the retaining element and the toothed portion of the toothed component.

21. Vehicle window regulator device, according to claim 14, wherein further comprises a drive motor for the rotation of the toothed gear.

22. Vehicle window regulator device, according to claim 21, wherein the drive motor is fixed to the housing by way of a bolt, said bolt comprising a stem which traverses the housing, in alignment with the first arm of the retaining element, in the operational position of said retaining element, pushing the first arm in a direction perpendicular to a meshing plane between the first arm of the retaining element and the toothed portion of the toothed component, thus shifting the first arm from its operational to its non-operational position.

23. Vehicle window regulator device, according to claim 22, wherein said retaining element comprises a second arm, and wherein the second arm comprises a through-hole via which the bolt passes when the drive motor is anchored to the housing.

* * * * *